US005454770A

United States Patent [19]

Stevens

[11] Patent Number: 5,454,770

[45] Date of Patent: Oct. 3, 1995

[54] STEPPER WTIH SENSOR SYSTEM

[76] Inventor: Clive G. Stevens, 2F, No.3, Alley 25, Lane 208, Jui-An St., Taipei City, Taiwan, Prov. of China

[21] Appl. No.: 153,418

[22] Filed: Nov. 15, 1993

[51] Int. Cl.[6] ..... A63B 23/04; A63B 21/00

[52] U.S. Cl. ..... 482/52; 482/902

[58] Field of Search ..... 482/3–9, 51, 52, 482/53, 70, 72, 73, 900, 901, 902, 903

[56] References Cited

U.S. PATENT DOCUMENTS

| | | | |
|---|---|---|---|
| 4,674,741 | 6/1987 | Pasierb et al. | 482/902 |
| 4,711,450 | 12/1987 | McArthur | 482/902 |
| 4,714,244 | 12/1987 | Kolomayets et al. | 482/900 |
| 4,838,543 | 6/1989 | Armstrong et al. | 482/53 |
| 4,867,447 | 9/1989 | Johnson | 482/73 |
| 4,934,694 | 6/1990 | McIntosh | 482/902 |
| 4,938,474 | 7/1990 | Sweeney et al. | 482/52 |

*Primary Examiner*—Stephen R. Crow
*Attorney, Agent, or Firm*—Ladas & Parry

[57] ABSTRACT

A stepper is incorporated with a sensor system and includes a frame assembly with a base frame and a center beam mounted securely on the base frame, and two foot-pedal arms located on two sides of the center beam. Each of the foot-pedal arms has an end mounted pivotally on the frame assembly. The sensor system is adapted to monitor exercise performance and generate exercise information and includes a photo-detecting unit mounted operatively on the frame assembly, a slotted wheel mounted axially on the end of a corresponding one of the foot-pedal arms, and an instrument control unit. The photo-detecting unit includes two photo emitters and two photo receivers. Each of the photo receivers is opposite to and aligned with a corresponding one of the photo emitters. The slotted wheel has a flange member extending toward the center beam and between the photo emitters and the photo receivers. The flange member has a plurality of angularly spaced-apart openings. The slotted wheel swings with the corresponding one of the foot-pedal arms to permit the photo receivers to receive light intermittently from the corresponding photo emitters. The instrument control unit is connected electrically to the photo-detecting unit so as to process signals therefrom and generate the exercise information based on the signals.

4 Claims, 5 Drawing Sheets

STEPPER WTIH SENSOR SYSTEM

BACKGROUND OF THE INVENTION

1. Field Of The Invention

This invention relates to a stepper, more particularly to a stepper that is provided with a sensor system which is capable of monitoring exercise performance and which can generate corresponding exercise information.

2. Description Of The Related Art

It is important when exercising to have some monitoring or feedback of the exerciser's progress or performance. Information such as the distance traveled or the speed is essential. In the case of a conventional stepper, information, such as the total number of steps and the average number of steps per minute, is required by the exerciser. Referring to FIG. 1, a conventional stepper is shown to include a frame assembly (A), two foot-pedal arms (B), a sensor unit (C) mounted operatively on the frame assembly (A), and an instrument control unit (D) connected electrically to the sensor unit (C) so as to process signals from the latter in order to calculate the above information and display the same on an LED or LCD thereof. Each of the foot-pedal arms (B) is mounted pivotally on the frame assembly (A) at one end thereof. A magnet (M) is provided on one of the foot-pedal arms (B) and moves synchronously with said one of the foot-pedal arms (B). The sensor unit (C) is a magnetic reed switch which is mounted operatively on the frame assembly and which is operated or activated when the magnet (M) passes close thereto. That is, supposing that the reed switch is originally "OFF", the reed switch is turned on when the magnet (M) passes close thereto. Thus, the instrument control unit (D) receives information regarding how many times the reed switch was turned off or on to enable the former to calculate the desired exercise information and display the same on an LED or LCD.

The use of a reed switch in the stepper results in the following drawbacks:

1. Since the reed switch is mechanical and has moving parts, breakdown or failure of the reed switch is likely to occur after prolonged use of the stepper.
2. The reed switch is not activated if the magnet does not pass close enough thereto, thereby resulting in the provision of inaccurate electrical signals to the instrument control unit (D).
3. The reed switch serves as a counter since it can only generate "ON" or "OFF" signals. Thus, some exercise information, such as the amount of calories consumed, cannot be determined accurately because this requires additional information which the reed switch cannot provide, like the angular movement of the foot-pedal arms.
4. When the reed switch is in use, the speed of the angular movement of the foot-pedal arms cannot be detected. Thus, a slow short rotation of the foot-pedal arms cannot be distinguished from a fast long rotation of the same. Therefore, the amount of exercise effort determined is inaccurate since the above information are also required to achieve a precise calculation.

SUMMARY OF THE INVENTION

Therefore, the main object of the present invention is to provide a stepper that has a sensor system which is adapted to monitor exercise performance and generate accurate exercise information.

According to the present invention, a stepper, which is incorporated with a sensor system, includes a frame assembly and two foot-pedal arms. The frame assembly includes a base frame and a center beam mounted securely on the base frame. The foot-pedal arms are located on two sides of the center beam. Each of the foot-pedal arms has a rear end mounted pivotally on the frame assembly. The sensor system is adapted to monitor exercise performance and generate exercise information, and comprises a photo-detecting unit, a slotted wheel and an information control unit. The photo-detecting unit is mounted operatively on the frame assembly and includes two photo emitters and two photo receivers. Each of the photo receivers is opposite to and is aligned with a corresponding one of the photo emitters. The slotted wheel is mounted axially on the rear end of one of the foot-pedal arms and has a flange member extending toward the center beam and between the photo emitters and the photo receivers. The flange member has a plurality of angularly spaced-apart openings. The slotted wheel swings with said one of the foot-pedal arms to permit the photo receivers to receive light intermittently from the corresponding photo emitters. The information control unit is connected electrically to the photo-detecting unit so as to process signals from the photo-detecting unit and generate the exercise information based on the signals.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
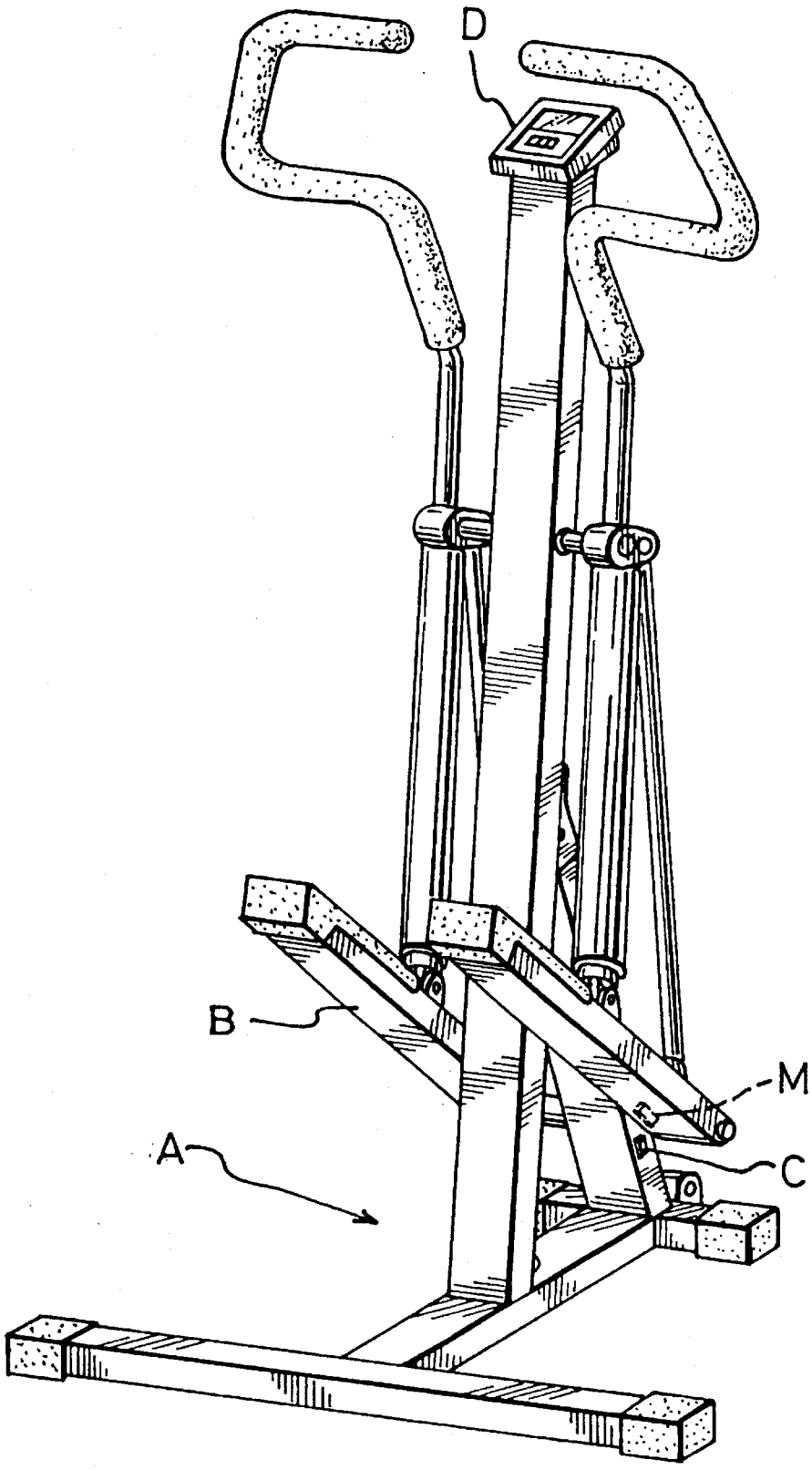
FIG. 1 is a partly exploded view of a conventional stepper that is incorporated with a sensor unit.
Figure 2:
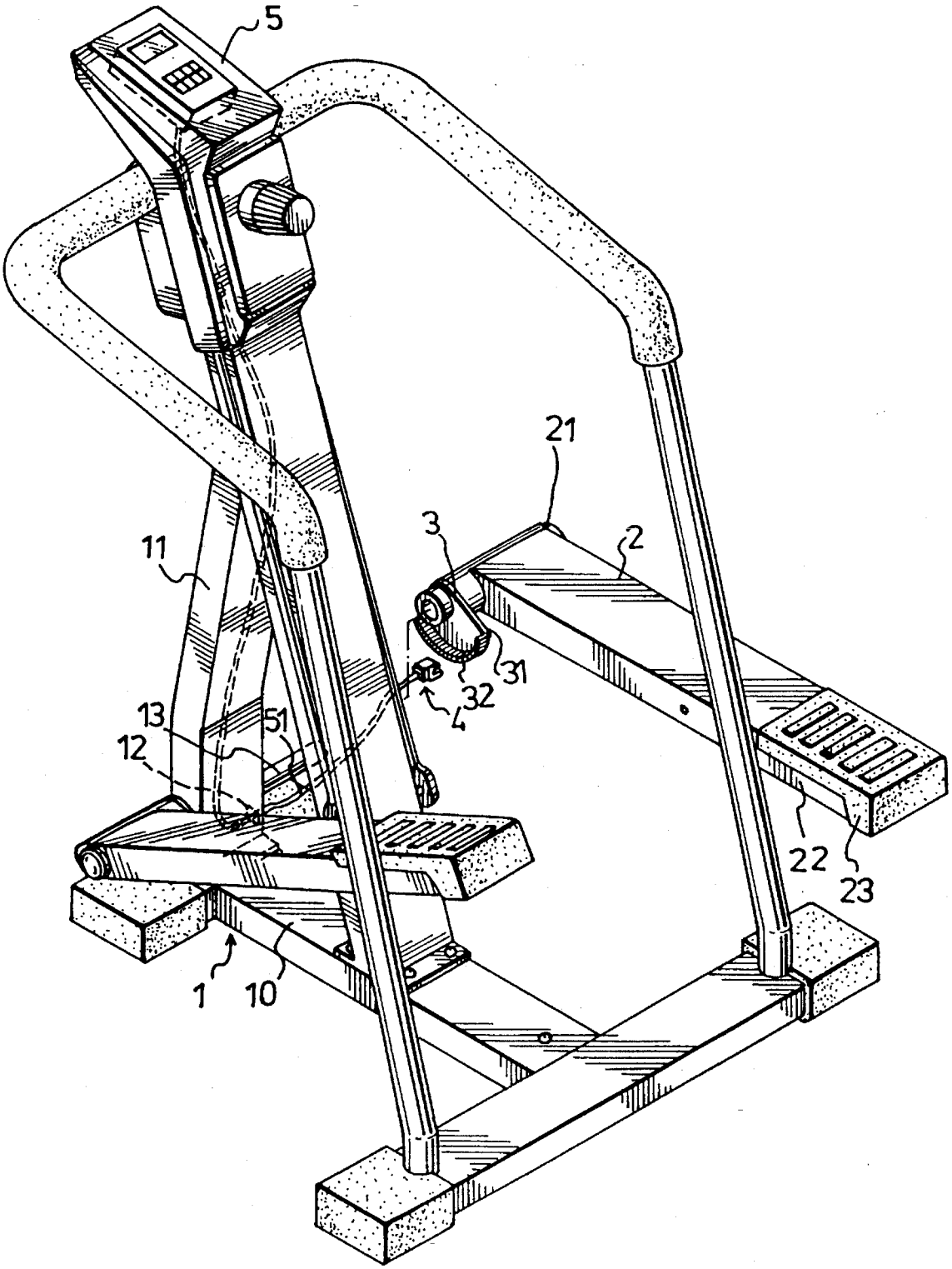
FIG. 2 is a partly exploded view of a stepper that is incorporated with a sensor system according to a first embodiment of the present invention.
Figure 3:
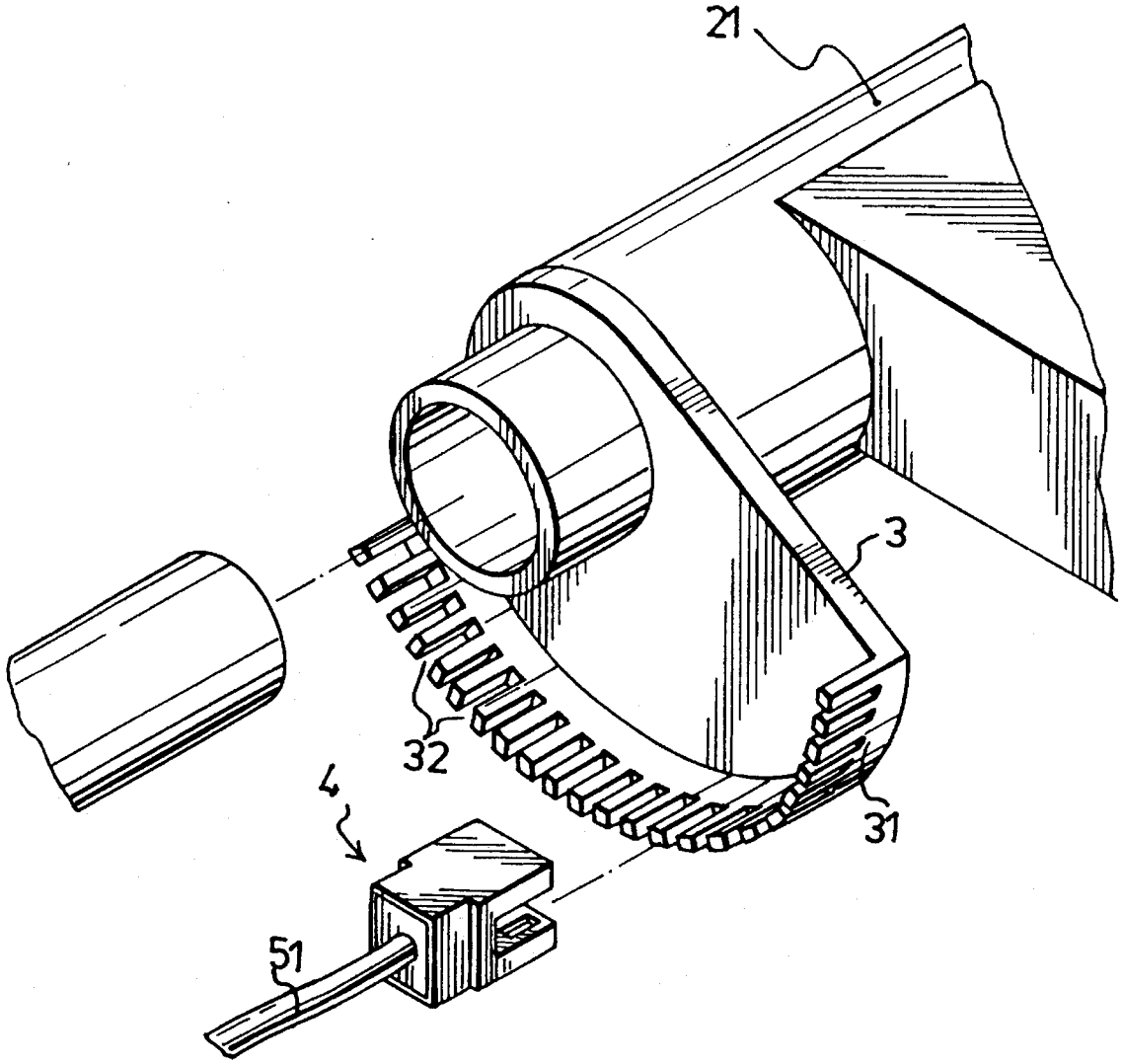
FIG. 3 is an enlarged view showing the slotted wheel of the sensor system in FIG. 2.
Figure 4:
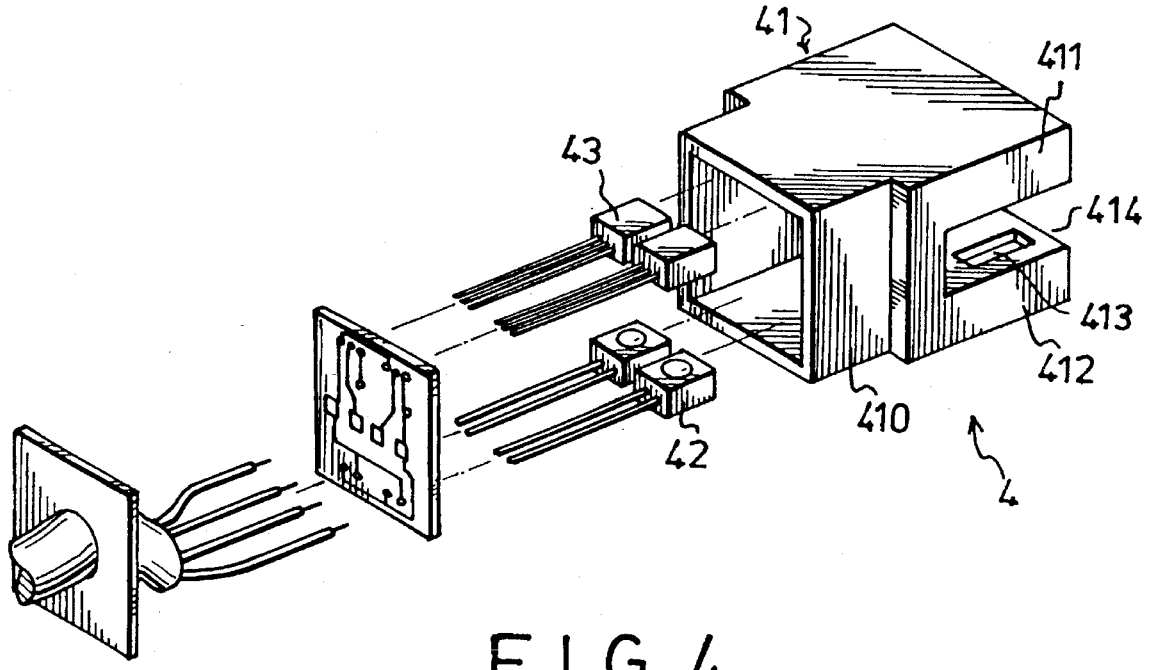
FIG. 4 is an exploded view showing the photo-detecting unit of the sensor system in FIG. 2.

Referring to FIGS. 2, 3 and 4, a stepper that is incorporated with a sensor system in accordance with a first embodiment of the present invention includes a frame assembly 1 and two foot-pedal arms 2. The sensor system is adapted to monitor exercise performance and generate exercise information, and comprises a slotted wheel 3, a photo-detecting unit 4 and an instrument control unit 5.

The frame assembly 1 includes a base frame 10 and a center beam 11 which is mounted securely on the base frame 10. The center beam 11 has two opposed side walls. Two opposed pivot rods 13 extend respectively from the two side walls of the center beam 11 and away from each other. One of the side walls of the center beam 11 has a receiving hole 12 that is formed in a surface thereof and that is located between the base frame 10 and the pivot rod 13.

The foot-pedal arms 2 are located on two sides of the center beam 11. Each of the foot-pedal arms 2 has a rear end portion 21 mounted pivotally on a corresponding one of the opposed pivot rods 13, and a front end portion 22 on which a foot-pedal 23 is mounted securely.

The photo-detecting unit 4 includes a hollow housing 41, two photo emitters 42 which emit infrared light and two photo receivers 43 which receive infrared light from a corresponding one of the photo emitters 42. The housing 41 has a mounting part 410 which is sized to be fitted within the receiving hole 12 in the center beam 11 of the frame assembly 1, and two opposed extensions 411,412 which extend from the mounting part 410 and which are spaced apart from each other. The opposed extensions 411,412 cooperatively define a gap 414 therebetween. Each of the extensions 411,412 has an inner surface formed with two slots 413 which are spaced apart from each other by a predetermined distance. Each of the slots 413 in one of the extensions 411,412 is aligned with a corresponding one of the slots 413 in the other one of the extensions 411,412. Each of the photo emitters 42 is installed in the extension 412 of the housing 41 in a respective one of the slots 413 of the extension 412. Similarly, each of the photo receivers 43 is installed in the extension 411 of the housing 41 in a respective one of the slots 413 in the extension 411.

Figure 5:
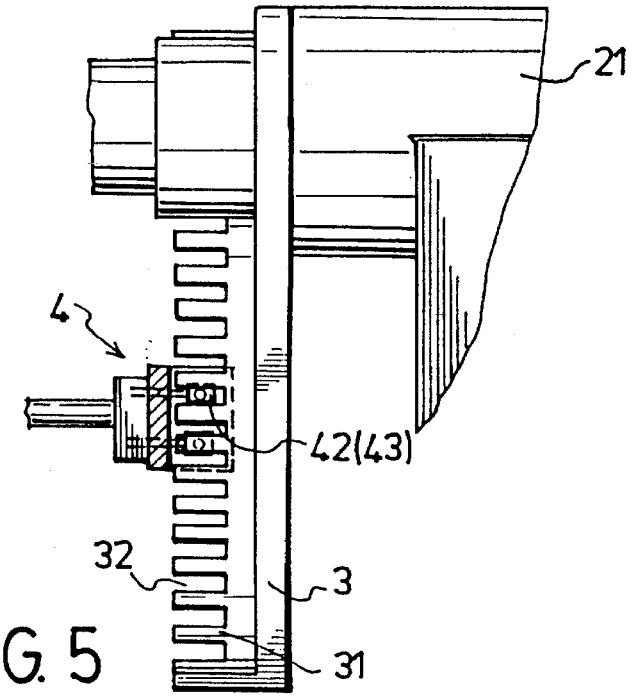
FIG. 5 is a plan view showing the relationship between the openings in the flange member of the slotted wheel and the photo emitters of the photo-detecting unit of the sensor system in FIG. 2.

The slotted wheel 3 is mounted axially on the rear end portion 21 of the foot-pedal arm 2 which is adjacent to the photo-detecting unit 4. The slotted wheel 3 has a flange member 31 extending toward the center beam 11 and into the gap 414 between the photo emitters 42 and the photo receivers 43. In this embodiment, the slotted wheel 3 is shaped as a circular segment which is about forty degrees. The angle of the segment may be varied vary as required. The flange member 31 has a plurality of angularly spaced-apart openings 32. The openings 32 in the flange member 31 are placed at every four degrees but this may change according to design choice. The slotted wheel 3 swings with said one of the foot-pedal arms 2 to permit the photo receivers 43 to receive light intermittently from the corresponding photo emitters 42. Referring to FIG. 5, it is important to note that one of the photo emitters 42 is aligned with one of the openings 32 when the other one of the photo emitters 42 is misaligned with the openings 32. This enable the sensor system to determine the direction of movement of the foot-pedal arms 2. That is, if the direction of movement of the slotted wheel 3 is changed, the photo receiver 43 that was receiving infrared light first during the motion in one direction receives it last when the slotted wheel 3 moves in the opposite direction.

The instrument control unit 5 is mounted operatively on a top end of the center beam 11 and is connected electrically to the photo-detecting unit 4 by means of a cable unit 51 so as to process signals from the photo-detecting unit 4 and generate the exercise information based on the signals.

In operation, the slotted wheel 3 swings with said one of the foot-pedal arms 2 so as to permit each of the photo receivers 43 to receive light intermittently from the corresponding photo emitter 42 and thus generate a square wave output. The frequency of the square wave outputs changes with the angular speed of the slotted wheel 3. The instrument control unit 5 can generate speed information based on the frequency of the square wave outputs. Since the openings 32 are located at every four degrees, and since the sensor system knows whether a change of direction took place, the sensor system is capable of detecting how many degrees of rotation took place between each change of direction so that the instrument control unit 5 can generate the exercise information accurately. Furthermore, since each change of direction records one "count" and since the angular rotation during such a change can be as small as the displacement between two adjacent openings 32, it does not matter where the change of direction takes place throughout the entire range of motion of the foot-pedal arm 2. Thus, all of the information which are desired by the exercise, such as distance traveled, the number of calories consumed and the like, can be generated accurately.

Figure 6:
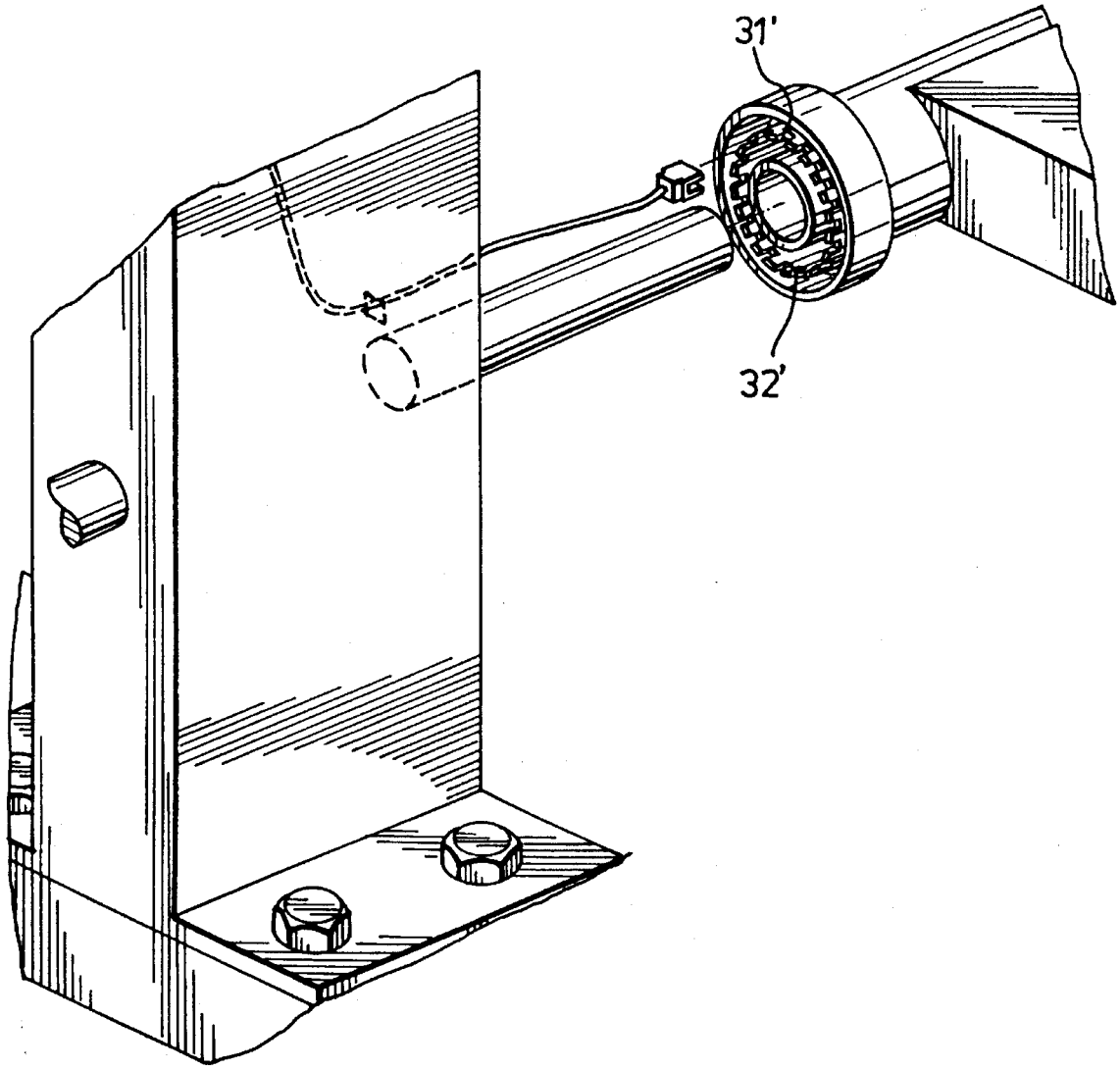
FIG. 6 is a partly exploded view of a stepper that is incorporated with a sensor system according to a second embodiment of the present invention.

Referring now to FIG. 6, a second embodiment of the present invention is shown. Unlike the first embodiment, the flange member 31' is shaped in an annular ring, wherein the openings 32' are located at every fifteen degrees. The operation of the second embodiment is similar to that of the previous embodiment and will not be detailed further.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A stepper with a sensor system to monitor exercise performance and generate exercise information, comprising:

a frame assembly which includes a base frame and a center beam mounted securely on said base frame;

two foot-pedal arms respectively on opposite sides of said center beam, each of said foot-pedal arms having an end mounted pivotally on said frame assembly for pivoting about an axis transverse to said center beam;

a photo-detecting unit mounted operatively on said frame assembly, said photo-detecting unit including a first photo emitter and a first photo receiver opposite to and aligned with said first photo emitter;

a slotted wheel mounted on said pivot axis of said end of one of said foot-pedal arms with a flange member extending toward said center beam and between said first photo emitter and said first photo receiver, said flange member having a plurality of angularly spaced-apart openings, said slotted wheel swinging with said one of said foot-pedal arms to permit said first photo receiver to receive light intermittently through said openings from said first photo emitter and produce electrical signals corresponding thereto; and an instrument control unit connected electrically to said photo-detecting unit so as to process said signals from said photo-detecting unit and generate exercise information based on said signals.

2. A stepper as claimed in claim 1, wherein said photo-detecting unit includes a second photo emitter set up next to said first photo emitter, one of said first and second photo emitters being aligned with one of said openings when the other of said first and second photo emitters is misaligned with said openings.

3. A stepper as claimed in claim 1, wherein said slotted wheel is shaped as a circular segment.

4. A stepper as claimed in claim 1, wherein said flange member is shaped as an annular ring.

* * * * *